US005555678A

United States Patent [19]

Schoo

[11] Patent Number: 5,555,678

[45] Date of Patent: Sep. 17, 1996

[54] TUBULAR COLUMN OF HIGH RESISTANCE TO BUCKLING

[76] Inventor: Raul A. I. Schoo, Bolivar 547, Piso 6, 1066 Buenos Aires, Argentina

[21] Appl. No.: 196,573

[22] Filed: Feb. 15, 1994

[30] Foreign Application Priority Data

May 7, 1993 [AR] Argentina ..... 324896

[51] Int. Cl.[6] ..... E04H 15/20

[52] U.S. Cl. ..... 52/2.13; 52/2.11; 52/223.1; 220/581; 220/590

[58] Field of Search ..... 52/2.11, 2.13, 52/720, 223.1; 220/581, 590

[56] References Cited

U.S. PATENT DOCUMENTS 4,685,253 8/1987 Bitterly ..... 52/2.11

4,865,210 9/1989 Brainard, II ..... 220/590

5,284,996 2/1994 Vickers ..... 220/590 X

*Primary Examiner*—Carl D. Friedman

*Assistant Examiner*—W. Glenn Edwards

*Attorney, Agent, or Firm*—Lackenbach Siegel et al.

[57] ABSTRACT

In a preferred embodiment, a device for sustaining longitudinal compressive loads applied to the ends thereof, the device including: a longitudinally extending tube; devices to seal the ends of the tube; pressurized fluid within the tube, the pressurized fluid having a pressure greater than the external pressure on the tube.

9 Claims, 1 Drawing Sheet

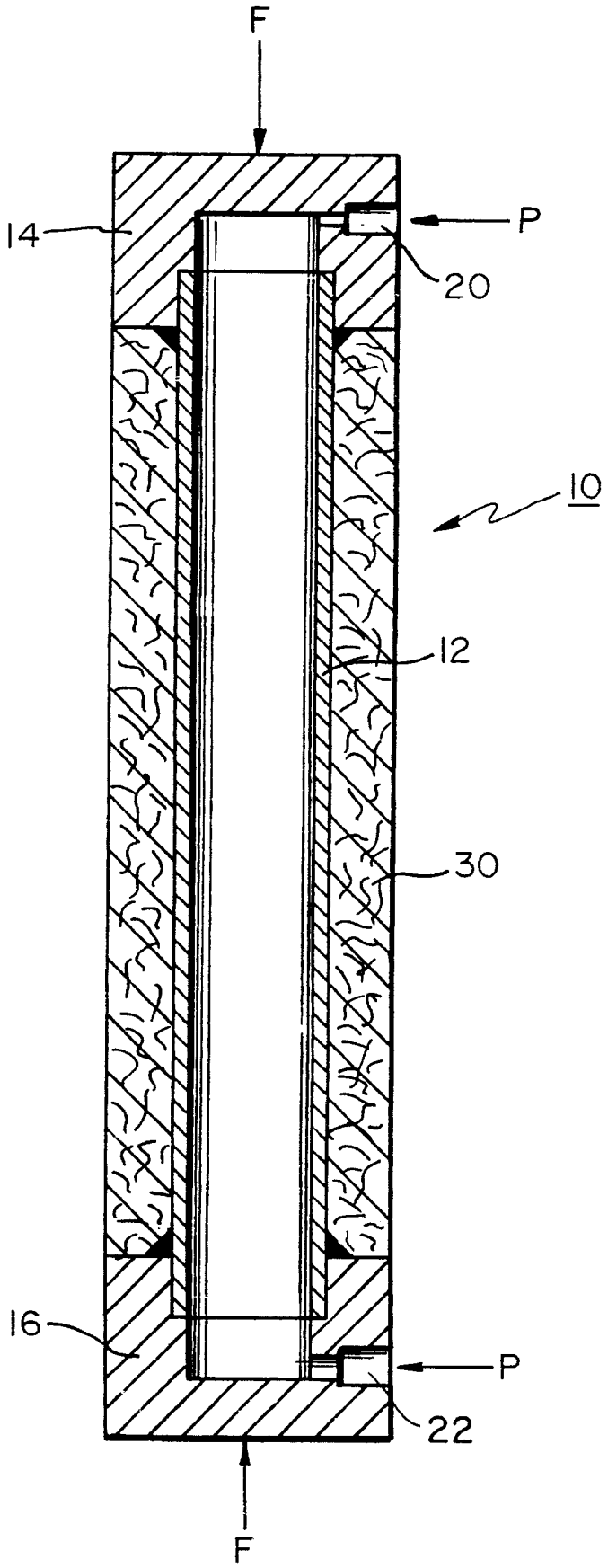
F
14
P
20
10
12
30
16
P
22
F

TUBULAR COLUMN OF HIGH RESISTANCE TO BUCKLING

BACKGROUND OF THE INVENTION

1. Field of the Invention

The present invention relates to structural members generally and, more particularly, but not by way of limitation, to a novel tubular column of high resistance to buckling.

2. Background Art

The maximum compressive load that structural bars or slender columns can resist, for a given material of construction and length, is generally a function of its diameter or width and the thickness of the material of construction, with the maximum load increasing with increased width and/or thickness. As a result, structural bars or slender columns for large loads tend to be heavy and expensive.

Accordingly, it is a principal object of the present invention to provide a structural bar or slender column that is lighter in weight than a structural bar or slender column of conventional construction.

It is a further object of the invention to provide such a structural bar or slender column that is simply and economically constructed.

Other objects of the present invention, as well as particular features, elements, and advantages thereof, will be elucidated in, or be apparent from, the following description and the accompanying drawing figure.

SUMMARY OF THE INVENTION

The present invention achieves the above objects, among others, by providing, in a preferred embodiment, a device for sustaining longitudinal compressive loads applied to the ends thereof, comprising: a longitudinally extending tube; means to seal the ends of said tube; a pressurized fluid within said tube, said pressurized fluid having a pressure greater than the external pressure on said tube.

BRIEF DESCRIPTION OF THE DRAWING

Understanding of the present invention and the various aspects thereof will be facilitated by reference to the accompanying drawing figure, submitted for purposes of illustration only and not intended to define the scope of the invention, on which:

FIG. 1 is a side elevational view, in cross-section, of a tubular column constructed according to the present invention.

DETAILED DESCRIPTION OF THE PREFERRED EMBODIMENTS

The basic essence on which the present invention rests is a tubular column subjected to extremely high internal pressures, which internal pressures bring about internal longitudinal tensile stresses of high values. These high internal stresses of longitudinal traction stress the column, with the particularity that they are internal forces which tend to stiffen the column and to preserve its original form.

Following are the mathematical comparative calculations which are the mathematical proof that illustrates the advantage of this invention by comparing it with conventional designs. It will be understood that this mathematical proof is simplified, in that it does not consider second-order effects and that it does not enter into what is called the mathematical theory of elasticity in a totally rigorous and academic manner.

The critical buckling load of a slender bar, according to Euler, is given by:

$$Pcr=(PI^2\times E\times I)/L^2,$$

in which

Pcr is the critical buckling load expressed in kilograms,

E is the modulus of elasticity of the material of the bar expressed in kilograms per square centimeter, I is the minimum moment of inertia of the section normal to the axis of the piece expressed in centimeters to the fourth power, and L is the equivalent length of the bar expressed in centimeters.

The assumed conditions of the anchoring of the bar are that the bar is articulated at both ends, so that the equivalent Euler length, L, coincides with the actual length of the bar.

The section of the bar under consideration is annular, so the moment inertia of the bar is given by:

$$I=[PI\times(B^4-A^4)]/4,$$

in which

I is the moment of inertia expressed in centimeters to the 4th power,

B is the outside radius of the tube expressed in centimeters, and

A is the inside radius of the tube expressed in centimeters.

The surface of the annular section is given by:

$$F=PI\times(B^2-A^2),$$

in which

F is the surface of the annular section expressed in square centimeters,

B is the outside radius of the tube expressed in centimeters, and

A is the inside radius of the tube expressed in centimeters.

The tangential stress in the tubular body is given by:

$$St=[P\times(B^2-A^2)]/(B^2+A^2),$$

in which

St is the tangential or circumferential stress to which the wall of the tube that forms the bar is subjected, brought about in the internal pressure, expressed in kilograms per square centimeter, P is the internal manometric pressure to which the tubular body of the bar is subjected, expressed in kilograms per square centimeter, B is the outside radius of the tube expressed in centimeters, and A is the inside radius of the tube expressed in centimeters.

It is considered that the external pressure is atmospheric pressure.

The longitudinal stress in the tubular body is given by:

$$Sl=(P\times A^2)/(B^2-A^2),$$

in which

Sl is the longitudinal tensile stress in the tubular body, brought about by the internal pressure, expressed in kilograms per square centimeter, P is the internal manometric pressure to which the tubular body of the bar is subjected, expressed in kilograms per square centimeter, B is the outside radius of the tube in centimeters, and A is the inside radius of the tube in centimeters.

It is considered that the distribution of longitudinal stress is uniform.

The maximum permissible pressure in the interior of the tube is given by:

$$P=Sf\times(B^2-A^2)/(B^2+A^2),$$

in which

Sf is the flow stress of the material of the tube expressed in kilograms per square centimeter, B is the outside radius of the tube expressed in centimeters, and A is the inside radius of the tube expressed in centimeters.

For the following calculations, it will be assumed that the tube under consideration has the following characteristics and properties:

Tube: seamless, one-inch diameter, Schedule 40 pipe of low-alloy steel, API Standard 5LX65, DE outside diameter= 3.34 cms, DI inside diameter= 2.07 cms, ES wall thickness=6.35 mms, L length= 1000 cms, E modulus of elasticity= 2,100,000 kgs/cm2, B outside radius=1.67 cms, A inside radius= 1.035 cms, Sf flow stress= 4.570 kgs/cm2, and Sr rupture stress=5,410 kgs/cm2.

First will be calculated the critical buckling load of the tubular bar without internal pressurization, that is, the conventional calculation of resistance/strength.

Inserting the formula for the moment of inertia in the formula for critical buckling load gives:

$$Pcr=[PI^3\times E\times(B^4-A^4)]/(4\times L^2).$$

Replacing values gives:

$$Pcr=[PI^3\times 2{,}100{,}000\times(1.67^4-1.035^4)]/(4\times 1000^2),$$

or

Pcr= 107.9 kilograms.

This value of compressive load is the limit value above which failure of the tubular bar is reached, with the concomitant loss of the stability thereof.

Now, assume that the interior of the tubular bar is pressurized with a working fluid which preferably will be hydraulic, but not excluding at least partially a pneumatic fluid. The maximum permissible internal pressure is:

$$P=4{,}570\times(1.67^2-1.035^2)/(1.67^2+1.035^2),$$

or

P= 2,033 kg/cm$^2$.

This very high internal pressure, the limitation of which is controlled by geometric dimensions and the magnitude of the permissible maximum stress of the material, not only brings about circumferential or tangential stresses in the wall of the tube, but also brings about radial stresses, which are of no use in the present invention, and longitudinal stresses, which bring about the mechanical principle of the present invention. The latter stresses stiffen the piece as a whole and are of critical importance when the tubular bar is subjected to a longitudinal compressive external load.

In fact, when the tubular bar is subjected to a high internal, longitudinal tensile stress, produced by the internal pressure, and subsequently when subjecting the bar to an external compressive load, the resultant state of stress will be the composition of both states considered independently, as deduced from the principle of superposition.

The longitudinal tensile stress is:

$$Sl=(2033\times 1.035^2)/(1.67^2-1.035^2),$$

or

Sl= 1,267 kg/cm$^2$.

The high internal pressure causes an internal tensile force, N, which is equivalent to the product of the longitudinal stress and the section normal to the axis of the tubular bar, or:

$$N=Sl\times F=Sl\times PI\times(B^2-A^2).$$

Replacing values gives:

$$N=1{,}276\times PI\times(1.67^2-1.035^2),$$

or

N= 6,837 kilograms.

According to the principle of superposition, if the tubular bar is pressurized to the maximum permissible pressure and the ends of the tubular bar are compressed longitudinally, the failure of the bar will occur when a stress value is reached which is the resultant of the composition of both independent states. That is to say, the new value of the critical buckling load of the tubular bar will be the sum of the value of the critical buckling load of the unpressurized tubular bar plus the value of the internal traction in the pressured tubular bar, or:

Failure load= 6,837+ 107.9= 6,944.9 kilograms.

Thus, the compressive strength of the pressurized tubular bar has been increased by a factor of 64 over that of the unpressurized tubular bar.

The above demonstration has disregarded secondary and second-order effects and does not pretend to be academic text, but it is eloquent enough to demonstrate the technological advantage of the present invention. The calculations also do not include the provision of outer circumferential reinforcement of high-strength synthetic fibers bonded to the tubular pipe to sustain the high circumferential stresses which normally double the value of the longitudinal stress that is of use and benefit.

FIG. 1 illustrates a tubular column according to the present invention, generally indicated by the reference numeral 10. Column 10 includes a cylindrical tube 12 having its ends sealed by means of first and second end pieces 14 and 16. End pieces 14 and 16 are constructed of the same material as tube 12, preferably a suitable metallic material (i.e., seamless steel or aluminum), are welded to the ends of tube 12, and have defined therein channels 20 and 22 for the application therethrough of a pressurized fluid to the interior of tube 12. Other means of attaching end pieces 14 and 16 to the ends of tube 12 may be employed as well, including threaded joints.

Surrounding the exterior surface of tube 12 is a layer 30 of synthetic fibers, for example, Kevlar or Araldit fibers, which cooperates in absorbing tangential forces in the tube to increase the maximum permissible pressure thereof, as is described above. The synthetic fibers referred to herein produced from long-chain polyamides (nylons) in which 85% of the amide linkages are attached directly to two aromatic rings called aramids. Nomex and Kelvar from Du Pont Co. and Twaron from Akzo NV are examples of fibers that can be used. Layer 30 is applied to tube 12 and bonded with a suitable resin using known techniques for fabricating such a reinforced structure. The source (not shown) of the pressurized fluid may be any conventional mechanical element, pump or compressor, or from any special installation that keeps tube 12 pressurized. Check valves (not shown) may be provided to maintain pressurization of tube 12.

In use, a fluid (not shown) under pressure "P" is applied to the interior of tube 12 through channels 20 and 22 from external piping (not shown) to assist the tube in resisting compressive forces "F" applied longitudinally to column 10, in the manner described above.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A tubular column having no moving parts and having a high resistance to buckling and being capable of sustaining longitudinal compressive loads applied to the ends of said tubular column, comprising:

(a) a single, seamless longitudinally extending metal tube having an outer surface and an interior portion devoid of any moving parts;

(b) opposing end caps for receiving and sealing the ends of said tube; and (c) a highly pressurized fluid within said interior portion of said tube, said pressurized fluid having a pressure greater than atmospheric pressure, and generating internal longitudinal tensile stresses of relatively high values in said tube so as to stiffen and preserve said tube form when under compressive loading.

2. The tubular column as defined in claim 1 wherein said end caps are counterbored to receive therein the ends of said tube, and said end caps capable of sealing said tube notwithstanding said internal longitudinal tensile stresses.

3. The tubular column as defined in claim 2, wherein said tube and said end caps are joined by welding.

4. The tubular column as defined in claim 2, wherein said tube and said end caps are threadably attached.

5. The tubular column as defined in claim 1, wherein at least one of said end caps has a channel defined therein for the application therethrough of said pressurized fluid to said interior portion of said tube, and said end caps capable of sealing said tube notwithstanding said internal longitudinal tensile stresses.

6. The tubular column as defined in claim 1, further comprising:

a layer of synthetic reinforcing fibers wrapped about and surrounding said outer surface of said tube and bonded thereto to cooperate in absorbing tangential forces in the tube to increase the maximum permissible pressure thereof.

7. The tubular column as defined in claim 6, wherein said synthetic reinforcing fibers are Kevlar.

8. The tubular column as defined in claim 6 wherein said synthetic reinforcing fibers are Araldit.

9. The tubular column as defined in claim 1, wherein said tube and said end caps are made of the same material, and said end caps capable of sealing said tube notwithstanding said internal longitudinal tensile stresses.

* * * * *